US005886327A

United States Patent [19]

Lee

[11] Patent Number: 5,886,327

[45] Date of Patent: Mar. 23, 1999

[54] POWER SUPPLY UNIT FOR A MICROWAVE OVEN AND A HIGH-VOLTAGE FUSE USED THEREIN

[75] Inventor: Gye-hong Lee, Pyongtaeg, Rep. of Korea

[73] Assignee: Samsung Electronics Co., Ltd, Suwon, Rep. of Korea

[21] Appl. No.: 969,453

[22] Filed: Nov. 13, 1997

[30] Foreign Application Priority Data

Jun. 14, 1997 [KR] Rep. of Korea ..... 1997-24715

[51] Int. Cl.[6] ..... H05B 6/66

[52] U.S. Cl. ..... 219/715

[58] Field of Search ..... 219/715–723; 361/35, 39, 45, 104

[56] References Cited

U.S. PATENT DOCUMENTS 3,732,517 5/1973 Keto et al. ..... 337/278

4,318,150 3/1982 Eley et al. ..... 361/41

5,353,216 10/1994 Ayers et al. ..... 361/732

*Primary Examiner*—Teresa Walberg

*Assistant Examiner*—Jeffrey Pwu

*Attorney, Agent, or Firm*—Burns, Doane, Swecker & Mathis, L.L.P.

[57] ABSTRACT

A power supply for a microwave oven comprises a high-voltage transducer for receiving an AC voltage from a first coil and generating a high-voltage in a second coil; a high-voltage fuse having a first end connected to the second coil, and a grounded second end; a high-voltage diode for absorbing a surge-voltage grounded in parallel to the high-voltage condenser; and a magnetron connected to an output port of the high-voltage condenser, for radiating microwaves. The high-voltage fuse comprises an insulating member; a first fuse holder disposed in the insulating member; a second fuse holder having an annular ground ring opposed to the first fuse holder; a fuse body located between the first and second fuse holders; a lead wire electrically connected to the first fuse holder at one end thereof; and a fuse connection element joined to the other end of the lead wire.

2 Claims, 2 Drawing Sheets

POWER SUPPLY UNIT FOR A MICROWAVE OVEN AND A HIGH-VOLTAGE FUSE USED THEREIN

BACKGROUND OF THE INVENTION

1. Field of the Invention

The present invention relates to a power supply unit for a microwave oven and a high-voltage fuse used therein.

2. Description of the Prior Art

In general, a microwave oven is used to heat food in a heating chamber by sending microwaves generated in a magnetron controlled by a micro-computer. FIG. 1 shows a conventional power supply unit for a microwave oven.

Referring to FIG. 1, the conventional power supply unit includes a high-voltage transducer 10 which receives an AC voltage from a first coil T1 and generates a high voltage of 2000 V in a second coil T2, a high-voltage fuse 20 which is connected to an output port of the high-voltage transducer 10 and prevents an excessively large current, a high-voltage condenser HC which is connected to a port of the high-voltage fuse 20 and charges and discharges a high-voltage current, a grounded high-voltage diode HD which is connected in parallel to the high-voltage condenser HC and absorbs a surge voltage, and a magnetron M which is connected to an output port of the high-voltage condenser HC and radiates microwaves.

In the power supply unit for a microwave oven, in case a short is generated in one of the high-voltage transducer 10, the high-voltage diode HD, the high-voltage condenser HC, and the magnetron M, an excessively large current is generated in the second coil T2 of the high-voltage transducer 10. Then, a fusible member of the high-voltage fuse 20 which is connected to the second coil T2 of the high-voltage transducer 10 and the high-voltage condenser HC is fused by the current, thereby stopping the current flow and preventing the high-voltage transducer 10 from being damaged.

Considering that the operational voltage of the magnetron M is 4 KV, a high-voltage fuse of 5 KV is used in the power supply unit for a microwave oven, and FIG. 2 shows the high-voltage fuse 20 used in the power supply unit.

Referring to FIG. 2, the high-voltage fuse 20 used in the power supply unit includes a pair of cylindrical insulating members 22*a* and 22*b* which are engaged with each other, a pair of fuse holders 23*a* and 23*b* which are disposed in the insulating members 22*a* and 22*b* respectively, a fuse body 20' located between the fuse holders 23*a* and 23*b*, and a pair of lead wires 27*a* and 27*b* which are electrically connected to ends of the fuse holders 23*a* and 23*b* respectively, and a pair of fuse connecting elements 26*a* and 26*b* which are press-welded to ends of the lead wires 27*a* and 27*b*.

The fuse body 20' includes a conductive fusible member 24 which is inserted into a vacuumed glass tube 21 and a resilient member 25 which is connected to one end of the fusible member. In case the fusible member 24 is broken, the resilient member 25 retracts so that the distance between the broken surfaces of the fusible member 24 are separated by more than a predetermined distance, e.g., 15.5 mm when the operational voltage of the magnetron M is 4 KV.

The cylindrical insulating members 22*a* and 22*b* of the high-voltage fuse 20 have lengths sufficient to prevent transmission of the operational voltage of the magnetron M between the conductive portion of the fuse body 20' and the body of the microwave oven. In case the operational voltage of the magnetron M is 4 KV, the cylindrical insulating members 22*a* and 22*b* have lengths which can cover the lead wires 27*a* and 27*b* by at least 15.5 mm from uncoated portions of the lead wires 27*a* and 27*b*.

However, according to the above-mentioned power supply unit for a microwave oven and the high-voltage fuse, since the cylindrical insulating members 22*a* and 22*b* have lengths which can cover the lead wires 27*a* and 27*b* by at least 15.5 mm from the uncoated portions of the lead wires 27*a* and 27*b*, the total length of the assembled insulating members 22*a* and 22*b* is the sum of the length of the fuse body 20' plus the lengths of the uncoated portions of the lead wires plus at least 31 mm, so much assembling space is needed when the microwave is mounted.

Further, according to the above-mentioned power supply unit and high-voltage fuse, as shown in FIG. 1, the high-voltage fuse 20 is mounted between a high-voltage end of the second coil T2 of the high-voltage transducer 10 and the high-voltage condenser HC, so both ends of the high-voltage fuse 20 should remain at least 2 KV respectively. Further, two separate insulating members 22*a* and 22*b* are needed in the high-voltage fuse 20, so the fuse is long and the manufacturing processes of the high-voltage fuse 20 is complicated.

SUMMARY OF THE INVENTION

Therefore, it is a first object of the present invention to provide a power supply unit for a microwave oven in which the mounting position of the high-voltage fuse thereto is changed, and the entire length of an insulating member of the high-voltage fuse becomes shorter, and the high-voltage fuse can be conveniently mounted to the microwave oven.

It is a second object of the present invention to provide a high-voltage fuse used in a power supply unit for a microwave oven.

In order to achieve the above-mentioned first object of the present invention, there is provided a power supply unit for a microwave oven which comprises a high-voltage transducer for receiving an AC voltage from a first coil and generating a high-voltage in a second coil; a high-voltage condenser; a high-voltage fuse grounded to a grounded end of the second coil of the high-voltage transducer; a high-voltage diode for absorbing a surge-voltage grounded in parallel to the high-voltage condenser; and a magnetron connected to an output port of the high-voltage condenser, for radiating microwaves. The high-voltage fuse comprises an insulating member; a first fuse holder disposed in the insulating member; a second fuse holder having an annular ground ring opposed to the first fuse holder; a fuse body located between the first and second fuse holders; a lead wire electrically connected to the first fuse holder at one end thereof; and a fuse connection end press-welded to the other end of the lead wire.

In order to achieve the above-mentioned second object of the present invention, there is provided a high-voltage fuse which comprises an insulating member; a first fuse holder disposed in the insulating member; a second fuse holder having an annular ground ring opposed to the first fuse holder; a fuse body located between the first and second fuse holders; a lead wire electrically connected to the first fuse holder at one end thereof; and a fuse connection end press-welded to the other end of the lead wire.

As above-mentioned, when one end of the high-voltage fuse is connected to a grounded end of the second coil of the high-voltage transducer and the other end thereof is grounded to a grounded surface, the potential between the high-voltage fuse and the ground surface is less than 20 V during the normal state of the high-voltage fuse, and a high-voltage is applied to only one end of the high-voltage fuse in case the high-voltage fuse is broken.

Therefore, only a portion of the high-voltage fuse which is connected to the high-voltage transducer needs to be insulated from the ground surface, so the entire length of the high-voltage fuse becomes shorter than that of the conventional fuse.

BRIEF DESCRIPTION OF THE DRAWINGS

The above objects and other advantages of the present invention will become more apparent by a preferred embodiment of the invention described in detail with reference to the attached drawings in which.

DETAILED DESCRIPTION OF A PREFERRED EMBODIMENT OF THE INVENTION

Hereinafter, a power supply unit for a microwave oven and a high-voltage fuse used therein according to a preferred embodiment of the present invention will be explained in detail with reference to accompanying drawings.

Figure 1:
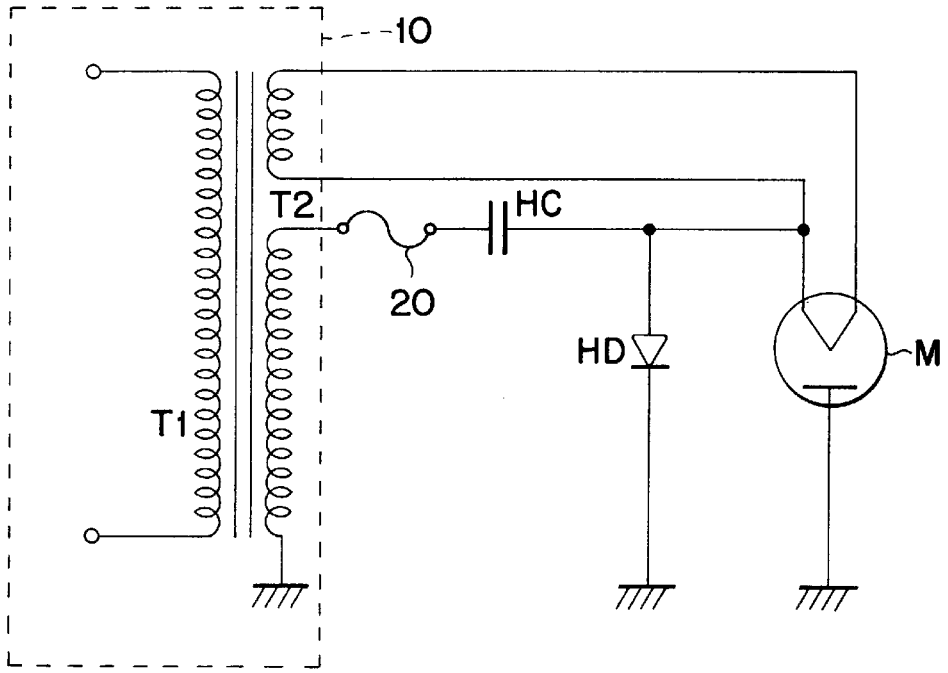
FIG. 1 (PRIOR ART)
FIG. 1 is a circuit diagram for showing a conventional power supply unit for a microwave oven.
Figure 2:
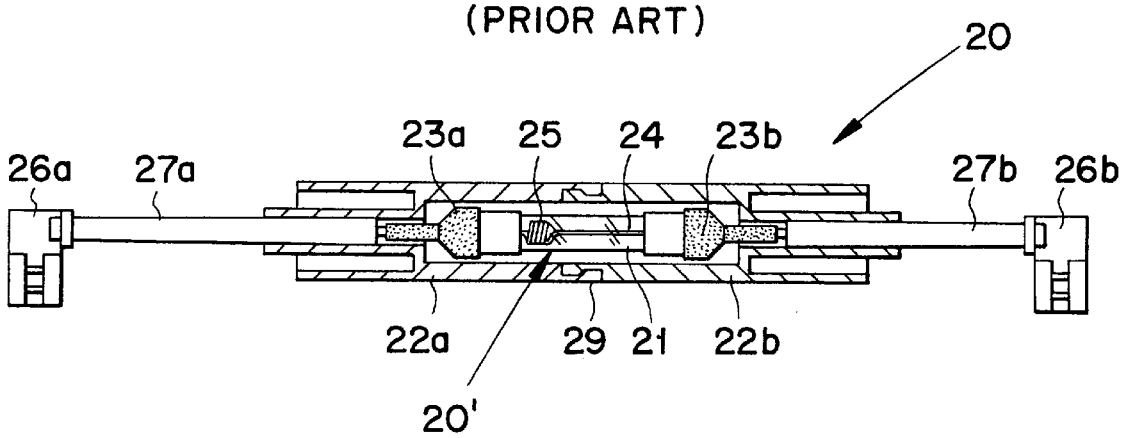
FIG. 2 (PRIOR ART)
FIG. 2 is a sectional view for showing a conventional high-voltage fuse used in the conventional power supply unit for a microwave oven.
Figure 3:
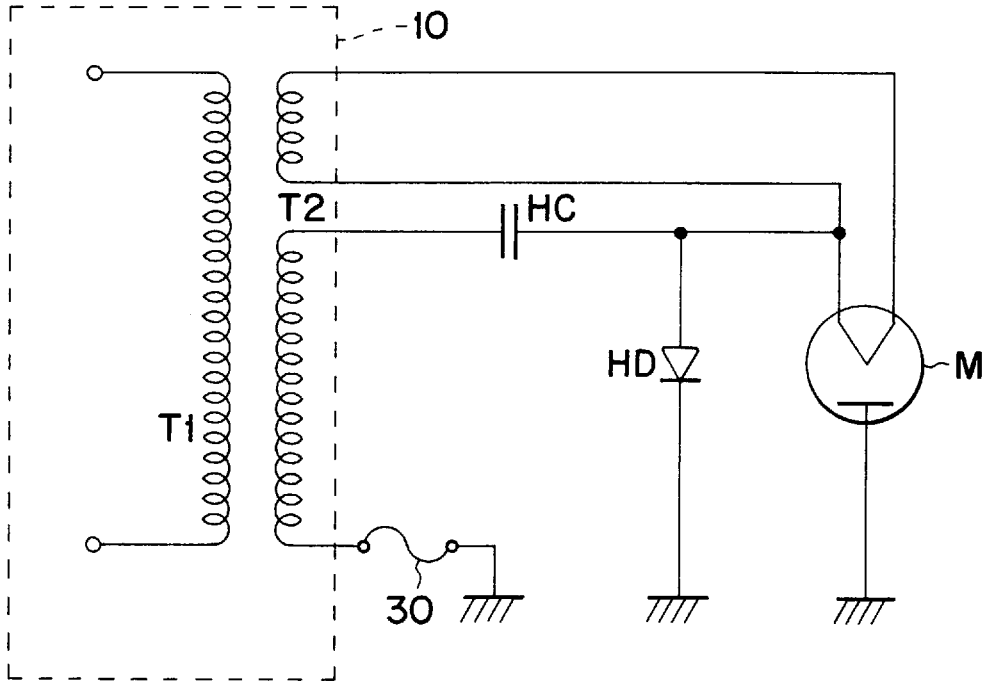
FIG. 3 is a circuit diagram for showing a power supply unit for a microwave oven according to the present invention.

FIG. 3 shows a power supply unit for a microwave oven according to the present invention.

Referring to FIG. 3, the power supply unit for a microwave oven according to the present invention includes a high-voltage transducer 10 which receives an AC voltage from a first coil T1 and generates a high voltage of 2000 V in a second coil T2, a high-voltage fuse 30 which is connected to a grounded end of the second coil T2 of the high-voltage transducer 10, a high-voltage condenser HC which is connected to an output port of the second coil of the high-voltage transducer 10 and charges and discharges a high-voltage current, a grounded high-voltage diode HD which is connected in parallel to the high-voltage condenser HC and absorbs a surge-voltage, and a magnetron M which is connected to an output port of the high-voltage condenser HC and radiates microwaves.

In the power supply unit for a microwave oven, in case a short is generated in one of the high-voltage transducer 10, the high-voltage diode HD, the high-voltage condenser HC, and the magnetron M, an excessively large current is generated in the second coil T2 of the high-voltage transducer 10. Then, a fusible member of the high-voltage fuse 30 is fused by the current, thereby stopping the current flow and preventing the high-voltage transducer 10 from being damaged.

Since one end of the high-voltage fuse 30 is connected to a grounded end of the second coil T2 of the high-voltage transducer 10 and the other end thereof is grounded, the potential between the high-voltage fuse 30 and the ground surface is less than 20 V during the normal operation of the microwave oven. A high-voltage is applied to one end of the high-voltage fuse 30 and the other end thereof is grounded if the high-voltage fuse 30 is broken. Therefore, only the portion of the high-voltage fuse 30 which is connected to the high-voltage transducer 10 needs to be insulated from the ground surface, so the entire length of the high-voltage fuse 30 can be shorter than that of the conventional one.

Figure 4:
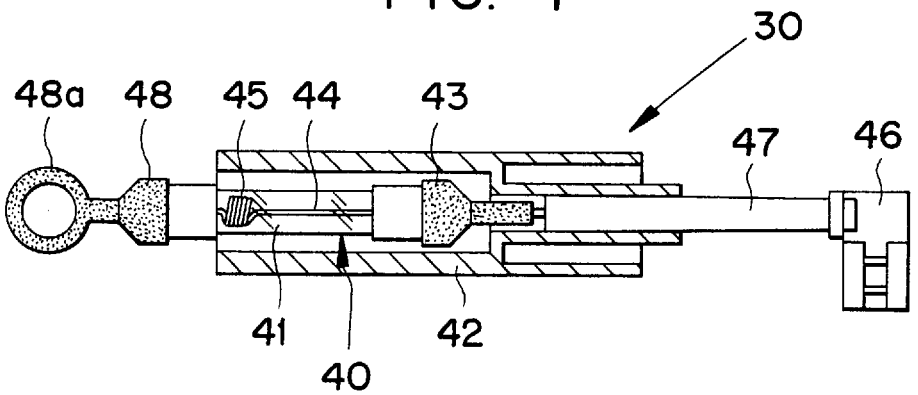
FIG. 4 is a sectional view for showing a high-voltage fuse used in the power supply unit for a microwave oven according to the present invention.

FIG.4 shows a high-voltage fuse used in a power supply unit for a microwave oven according to the present invention.

Referring to FIG. 4, the high-voltage coil according to the present invention 30 includes an insulating member 42, a first fuse holder 43 disposed in the insulating member 42, a second fuse holder 48 having an annular ground ring 48*a* which is opposed to the first fuse holder 43, a fuse body 40 located between the first and second fuse holders 43 and 48, a lead wire 47 one end of which is electrically connected to the first fuse holder 43, and a connection element 46 which is press-welded to the other end of the lead wire 47.

The insulating member 42 is opened at a grounded end, and the second fuse holder 48 is fixed by the annular ground ring 48*a* to a ground surface such as the body of the microwave oven and the body of the high-voltage transducer 10.

The fuse body 40 includes a conductive fusible body 44 which is inserted into a vacuumed glass tube 41 and a resilient member 45 which is connected to one end of the fusible member 44. In case the fusible member 44 is broken, the resilient member 45 retracts and the distance between the broken surfaces of the fusible member 44 assumes at least a predetermined value, e.g., 15.5 mm when the operational voltage of the magnetron M is more than 4 KV.

According to the power supply unit for a microwave oven and the high-voltage fuse according to the present invention, since only a portion of the high-voltage fuse 30 which is connected to the high-voltage transducer 10 needs to be insulated from a ground surface and the insulating member 42 only needs to have a length sufficient to cover the glass tube of the fuse body 40, the entire length of the high-voltage fuse 30 can be shorter than that of the conventional one and the high-voltage fuse 30 can be conveniently mounted to the microwave oven. Experiments show that the length of the high-voltage fuse 30 can be shorter than that of the conventional one by sixty percent.

Further, according to the power supply unit for microwave oven and the high-voltage fuse according to the present invention, since the annular ground ring 48*a* is formed at one end of the second fuse holder 48 and is fixed by a screw and thus grounded to a ground surface such as the body of the microwave oven and the body of the high-voltage transducer 10, one of the lead wires and the connection end thereof can be omitted. Therefore, the structure of the high-voltage fuse 30 can be simple and the manufacturing cost thereof can be lowered.

Although a preferred embodiment of the invention has been described, it is understood that the present invention should not be limited to that preferred embodiment, but various changes and modifications can be made by one skilled in the art within the spirit and scope of the invention as hereinafter claimed.

What is claimed is:

1. A microwave oven comprising:

a cooking chamber;

a magnetron for supplying microwaves to the cooking chamber; and a power supply for supplying electrical power to the magnetron, comprising:

a high-voltage transducer including first and second coils, the first coil connected to receive an AC voltage and generate a high voltage in the second coil, a high-voltage condenser connected to an output port of the second coil, the magnetron connected to an outlet port of the condenser, a high-voltage diode for absorbing a surge-voltage, grounded in parallel to the condenser, and a high-voltage fuse having a first end connected to the second coil of the transducer, and a grounded second end;

wherein the high-voltage fuse comprises:

an insulating member;

a fuse body having a first end disposed within the insulating member and a second end disposed adjacent one end of the insulating member;

a first fuse holder disposed in the insulating member for supporting the first end of the fuse body;

a second fuse holder situated outside of the insulating member for supporting the second end of the fuse body, the second fuse holder comprising a grounding ring connected to ground;

a lead wire having a first end connected to the first fuse holder at a location within the insulating member, and a second end disposed outside of the insulating member; and a connecting element attached to the second end of the lead wire and connected to the second coil.

2. The fuse according to claim 1 wherein the insulating member has an open end facing the second fuse holder.

* * * * *